US006827238B2

(12) United States Patent
Barker et al.

(10) Patent No.: US 6,827,238 B2
(45) Date of Patent: Dec. 7, 2004

(54) BEER DISPENSER

(75) Inventors: Andrew Barker, Birmingham (GB); Paul Campbell, Bedford (GB)

(73) Assignee: Carlsberg-Tetley Brewing Limited, Northampton (GB)

( * ) Notice: Subject to any disclaimer, the term of this patent is extended or adjusted under 35 U.S.C. 154(b) by 288 days.

(21) Appl. No.: 09/963,863

(22) Filed: Sep. 26, 2001

(65) Prior Publication Data

US 2002/0088826 A1 Jul. 11, 2002

Related U.S. Application Data

(63) Continuation of application No. PCT/GB00/01140, filed on Mar. 27, 2000.

(30) Foreign Application Priority Data

Mar. 26, 1999 (GB) ..... 9907135
Mar. 30, 1999 (GB) ..... 9907475

(51) Int. Cl.[7] ..... B67D 5/56
(52) U.S. Cl. ..... 222/129.1; 222/547
(58) Field of Search ..... 222/129.1, 547

(56) References Cited

U.S. PATENT DOCUMENTS 3,584,762 A * 6/1971 Vantroba et al. ..... 222/1
4,266,726 A * 5/1981 Brown et al. ..... 239/406
4,538,636 A 9/1985 Cleland ..... 137/216

FOREIGN PATENT DOCUMENTS

| | | |
|---|---|---|
| DE | 0 204 899 | 12/1986 |
| EP | 0 849 216 | 6/1998 |
| GB | 659 764 | 10/1951 |
| GB | 974 358 | 11/1964 |
| GB | 1 522 295 | 8/1978 |
| GB | 2 225 839 | 6/1990 |
| GB | 2 225 840 | 6/1990 |

* cited by examiner

*Primary Examiner*—Philippe Derakshani
(74) *Attorney, Agent, or Firm*—Patterson, Thuente, Skaar & Christensen, P.A.

(57) ABSTRACT

A beverage dispensing apparatus being formed so as in use to provide a vortex motion in the mass of beverage flowing through the apparatus. In the vortexial flow, a low pressure area is produced at the center of the vortex so that the pressure in that region falls below equilibrium pressure and thus results in gas separating out from the liquid beverage. Since the gas breakout is achieved without the need for a flow restrictor, the pressure drop associated with these devices does not occur. Consequently, the beverage may enter the apparatus at a lower pressure. Moreover it has been found that a high quality head is formed on the draught beverage dispensed from the apparatus of the invention.

33 Claims, 18 Drawing Sheets

PRESSURE DROP THROUGH DISPENSE LINE

BEER DISPENSER

This application is a continuation of PCT/GB00/01140 filed Mar. 27, 2000.

BACKGROUND OF THE INVENTION

1. Field of the Invention

The present invention relates to an apparatus for dispensing beverages, for example, beer, and in particular, but not exclusively, to a beer tap for dispensing draught beer.

When dispensing beer in a bar or other point-of-sale location, the beer is commonly stored in a keg at a remote location from the point of dispense. A gas cylinder which contains carbon dioxide, or a mixture of nitrogen and carbon dioxide is connected with the keg and serves to keep the dissolved gasses in solution and can drive beer from the keg to the dispense tap.

In order to ensure that the beer is in the correct condition as it is supplied to the tap, it is common to pass it through a cooler and a pressure restrictor before it is delivered to the tap. In some installations, a pump is provided between the keg and the tap.

In conventional beer dispense systems, the tap is a simple on-off tap which is spring biased into its on and off positions. Prior to use, the dispense system is set up with the intention that the beer is dispensed at the correct rate and in the correct condition when the tap is fully open. Conventional taps have a simple plug valve member which is moved into and out of engagement with a valve seat through which the beer flows. Downstream of the valve is a nozzle normally of uniform internal bore to bring the flow into a continuous stream. The intrinsic design of these valves does not readily allow controlled break out of gas from beer and, hence the extent of beer head formation may be variable.

A generic tap of the type described above which is used by pubs and bars for dispensing draught beer is (schematically illustrated in the schematic representation) shown in FIGS. 1 and 2. The tap comprises an inlet pipe 1 which opens into a cylindrical chamber 2. A valve head 3 is centrally located in the chamber and is arranged to close against a valve seat 4 which is formed on the upper end of a depending dispensing spout 5. The diameter of the valve head 3 is significantly less than the internal diameter of the chamber 2 so that beer may flow around all sides of the valve head to reach the dispensing spout 5. Thus, in use the beer flows into the tap through the inlet pipe, flows against the valve head 3 and then down through the dispensing spout. As can be seen from FIGS. 1 and 2, on impacting the valve head, some beer will flow in either direction around the head.

The inventors have recognized that this flow pattern gives rise to turbulence and stagnation points within the chamber 2, particularly in the region opposite the inlet pipe. This causes flow energy to be used up and thus a relatively large pressure drop is produced across the tap.

Thus, the beer in the kegs must be provided at a sufficiently high pressure to allow for this pressure drop.

In addition, the flow through the taps may have a detrimental effect on the quality of the beer being dispensed because the transition of the beer from an unsaturated to a supersaturated state may occur within the tap itself.

It is often important that beer be dispensed with an attractive head of foam. The head on draught beer is known to be produced from the breakout or separation of gas in the beer to produce bubbles and a "tight" creamy head formed of small bubbles is usually considered most desirable.

Beers currently marketed are generally of one of two types; ales typically containing 1.1–1.7% vol/vol of dissolved carbon dioxide and often 15–55 $mg.l^{-1}$ of dissolved nitrogen, or lagers containing 2.0–2.8% vol/vol of dissolved carbon dioxide. In either case, the beer enters the glass as a supersaturated solution which means that the dissolved gas it contains has the potential to break out of solution. The extent to which this occurs depends on a number of factors. These include the level of supersaturation, the flow conditions and the existence of nucleation sites to initiate bubble growth. During beer dispense, the generation of gas bubbles in solution originates predominantly by heterogeneous bubble nucleation. This means that bubbles are either nucleated at a surface containing pre-existing nucleation sites or in solution as a consequence of air being entrained in the beer as it flows into the glass.

2. Discussion of the Related Art

Many different methods have been tried in the past to produce a high quality head on draught beer. For example, nitrogen may be added to the beer and also a flow restrictor is usually provided in the base of the dispensing tap.

Such flow restrictors traditionally are flat discs containing five holes each having a diameter of from 0.5 to 1 mm. The decreased flow aperture provided by the holes causes a pressure drop across the flow restrictor producing gas breakout and the formation of a head on the beer.

However, the problem with these known taps having flow restrictors is that a high pressure drop occurs across the flow restrictor itself which can lead to a loss of control of head formation.

OBJECTS AND SUMMARY OF THE INVENTION

Viewed from a first aspect, the present invention provides a beverage dispensing apparatus, the apparatus being formed so as in use to provide a vortexial motion in the mass of beverage flowing through the apparatus.

The vortexial motion of the invention in the mass (i.e. the bulk) of the beverage is to be distinguished from the existence of localised vortices or eddies which occur in the turbulent-flow in disperse taps. However, it should be understood that the flow within the vortex will itself typically be turbulent.

In the vortexial flow of the invention, a low pressure area is produced at the center of the vortex so that the pressure in that region falls below equilibrium pressure and thus results in gas separating out from the liquid beverage. Since the gas breakout is achieved without the need for a flow restrictor, the pressure drop associated with these devices does not occur. Consequently the beverage may enter the apparatus at a lower pressure. Moreover it has been found that a high quality head is formed on the draught beverage dispensed from the apparatus of the invention.

It has been found particularly effective to provide the apparatus with a flow chamber having a substantially circular cross section in which the vortexial motion is induced together with an inlet leading to that chamber and an outlet leading therefrom.

A particularly effective way to induce the vortexial motion in such a chamber is for the inlet to extend substantially at a tangent to the circular cross section of the flow chamber. In this way, beverage flowing into the apparatus flows into the chamber from the inlet and along the inner face of its side wall. Thus the beverage flows around the chamber and thereby sets up a vortexial flow.

While it is possible to vary the direction of the flow of beverage relative to the flow chamber, preferably the beverage inlet comprises a conduit which extends substantially perpendicular to the longitudinal axis of the flow chamber so that the flow path of the beverage forms a tangent to the flow chamber, as previously discussed. Preferably the inlet conduct is also substantially horizontal.

Although the action of the beverage flowing around the walls of the flow chamber is sufficient to cause a vortex motion, it is significantly essential to have a vortex finder within the flow chamber aligned in relation to the beverage inlet such that, in use, beverage flowing into the flow chamber is guided in a circular path between the outer surface of the vortex finder and the inner wall of the flow chamber. Thus, with a vortex finder provided as described above, the beer flowing through the apparatus is encouraged to flow cyclically around the flow chamber.

The vortex finder could be of any form which provides the required flow pattern. Preferably however, the vortex finder comprises a portion in the form of a cylinder.

Still more preferably, the vortex finder further comprises a conic or frusto-conic part provided at the downstream end thereof (i.e. the end closer to the outlet). This further encourages the beverage to retain its vortex flow.

Since draught beverages are kept under pressure which propels the beverage through the dispensing system, the apparatus of the invention could be arranged in any orientation. Indeed, it could be provided as a mobile, hand held device. However, it is usually most convenient to dispense beverages from a generally vertical outlet e.g. fastened to a counter. It is therefore preferred that the flow chamber comprises an upstream portion defining a vortex finding chamber in which the vortex finder is located and a downstream portion depending from the upstream portion which preferably comprises a conic or frusto-conic part. In use the apparatus may be arranged substantially vertically such that the beverage flows helically downwardly through the downstream portion of the flow chamber assisted by the action of gravity and is dispensed through the outlet.

The flow chamber could be of any form which allowed vortexial flow to form and be maintained. For example, it could be in the form of a hollow cylinder. However, preferably the flow chamber is formed to enhance the vortex generating effect, for example by providing it with a main body having a circular cross section wherein at least the downstream portion thereof decreases in diameter along its axis in the downstream flow direction.

When the tap is formed as described above, the vortexial flow of the beverage will be accelerated as it flows towards the distal end of the flow chamber. This results in a gradually increasing radial pressure drop which increases gas breakout and thus improves the quality of the head which is formed.

The beverage could in use be allowed to flow directly out of the flow chamber. However, beverage flowing out without any further guidance may form a triangulated or cone shape. Thus preferably, a vortex breaker is provided, ideally in the downstream portion, near the exit point. Similar devices are well known in the art as flow directors. These enable beverage to flow out of the apparatus in a smooth straight column without significantly restricting its flow.

The invention in its simpler forms may be used in conjunction with an associated flow control such as a valve or tap provided upstream. However, it is particularly preferred for the flow control to be formed integrally such that there is provided a tap which may be used as a direct replacement of the prior art taps previously discussed.

An especially convenient way of achieving this objective is for the previously described vortex finder to be in the form of a valve head which acts in co-operation with the surfaces of the flow chamber and/or the outlet tube to control the flow of beverage through the apparatus.

Although the diameter of the flow chamber cross section could decrease evenly along its axis in the downstream flow direction, particularly when providing a vortex finder on the valve head, it is preferable that the vortex finding chamber defined by the upper portion of the flow chamber has a constant cross sectional diameter, i.e. be in the form of a hollow cylinder. This simplifies the design and manufacture of the valve head. The cross sectional diameter of the downstream portion of the flow chamber may then reduce in the downstream direction of flow as described above.

Since this valve arrangement is such that the beverage flows around the vortex finder (which forms the valve head) in a single direction in order to produce the vortex flow, it follows that the stagnation points associated with the prior art taps are significantly reduced if not eliminated. Consequently, there is a much smaller pressure drop across the valve which means that the pressure under which the beverage is kept may be further reduced.

This valve arrangement is, in itself, believed to be inventive and therefore, viewed from a second aspect, the invention provides a beverage dispensing tap comprising an inlet conduit, a flow directing chamber, a valve member located within the flow directing chamber and an outlet conduit leading from the flow directing chamber, wherein the inlet conduit is arranged in relation to the flow directing chamber such that beverage flowing into the tap is directed to flow around the valve member substantially in one direction.

Since this arrangement significantly reduces the pressure drop across the valve, it may be useful in many types of dispensing apparatus. However, it is particularly advantageous for the tap to be provided with the preferred features discussed above. In particular, the outlet conduit preferably depends from the flow directing chamber and is arranged such that the flow of beverage around the valve member establishes a vortexial flow within the outlet conduit.

The flow directing chamber may preferably be at least substantially cylindrical. However it is possible that conical or frusto-conical chambers could be developed in which case the valve member will preferably be similar such that a flow passage with concentric sides is formed.

The valve member may act against a valve seat formed at the upstream end of the outlet conduit. However, this may interfere with the desired vortexial flow and so it is preferred for the valve member to be provided with a portion arranged to close the flow path from the inlet to the flow directing chamber. The valve member should preferably be designed so as to open and close the flow path rapidly to avoid turbulence and gas breakout caused by a partially open flow path. This may, for example, be achieved by providing the valve member with a vortex finder portion having a diameter significantly less than that of the flow directing chamber and a valve portion having a diameter substantially the same as the inside diameter of the flow directing chamber, the valve member being axially movable within the flow directing chamber in such a way that the valve portion opens and closes the inlet conduit.

Alternatively, the flow path may be opened and closed by rotary motion of the valve member. This may be achieved by providing the valve member with a vortex finding portion having a diameter significantly less than the flow directing chamber and a circumferential wall portion located radially outward of the vortex finding portion and having a diameter substantially corresponding to that of the flow directing chamber, wherein an inlet port is provided in the circumferential wall portion and the valve member is rotatable within the flow directing chamber to bring the inlet conduit into and out of registration with the inlet port in such a way that the valve portion opens and closes the inlet conduit. The components could be made to sufficiently close tolerances to be self-sealing, but preferably a suitable sealing material is provided around the valve portion.

The apparatus of the invention could be made of any suitable material. Such materials include for example materials having a smooth surface such that nucleation sites upon which bubbles can grow and break out are not provided such as glass or plastics. Possible plastics material for construction of the tap are polymethyl methacrylate or nylon but, it is preferred that acetal be used since it is easily moldable to give a smooth finish and has a low moisture absorption characteristic and is a safe material to use in conjunction with a food product. In another preferred form, the tap is made of a corrosion resistant metal such as stainless steel having a smooth internal finish.

The apparatus of the invention could have a taper angle of the frusto-conic portion of up to about 45°. Preferably however, the conic or frusto-conic part of the apparatus has a taper angle of less than 30°. Still more preferably, the conic or frusto-conic part thereof has a taper angle of less than 15° or 10° or 7°. Yet more preferably, the conic or frusto-conic part thereof has a taper angle of between 7° and 3°. Optimum performance of the apparatus has been shown to be achieved with a taper angle of at least about 5° and still more preferably, the conic or frusto-conic part thereof has a taper angle of 5°. All of the above taper angles are defined relative to the longitudinal axis of the beverage dispensing apparatus.

It is envisaged that the dimensions of the apparatus of the invention could be chosen within a wide range. Preferably however, the conic or frusto-conic part thereof has a height of between 100 mm and 30 mm. Optimum performance of apparatus according to the invention has shown to be achieved within a narrower range of dimensions however and so, more preferably, the conic or frusto-conic part thereof has a height of 40 mm to 60 mm, e.g. about 50 mm.

The invention also provides a novel and improved way of dispensing a beverage and so, from a third aspect, the present invention provides a method of dispensing a draught beverage by forming a vortexial flow in the mass of the beverage as it is dispensed. According to a still further aspect of the invention there is provided a method of dispensing a beverage comprising supplying the beverage to a flow directing chamber having a valve member located therein such that the beverage flows around the valve member substantially in one direction before flowing out of the chamber and being dispensed.

Preferably the methods are performed using an apparatus as previously described.

BRIEF DESCRIPTION OF THE DRAWINGS

Certain embodiments of the invention will now be described, by way of example only, and with reference to the accompanying drawings, in which.

DESCRIPTION OF THE PREFERRED EMBODIMENTS

Figure 1:
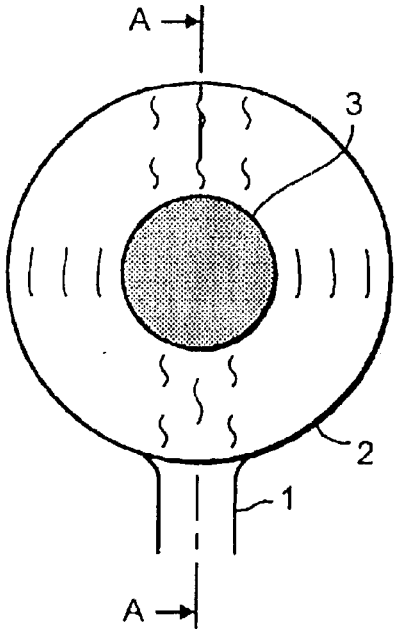
FIG. 1 Prior Art
FIG. 1 is a schematic sectional view of a beer dispensing tap according to the prior art.

Like reference numerals are used for the corresponding parts of each of the embodiments.

Figure 3:
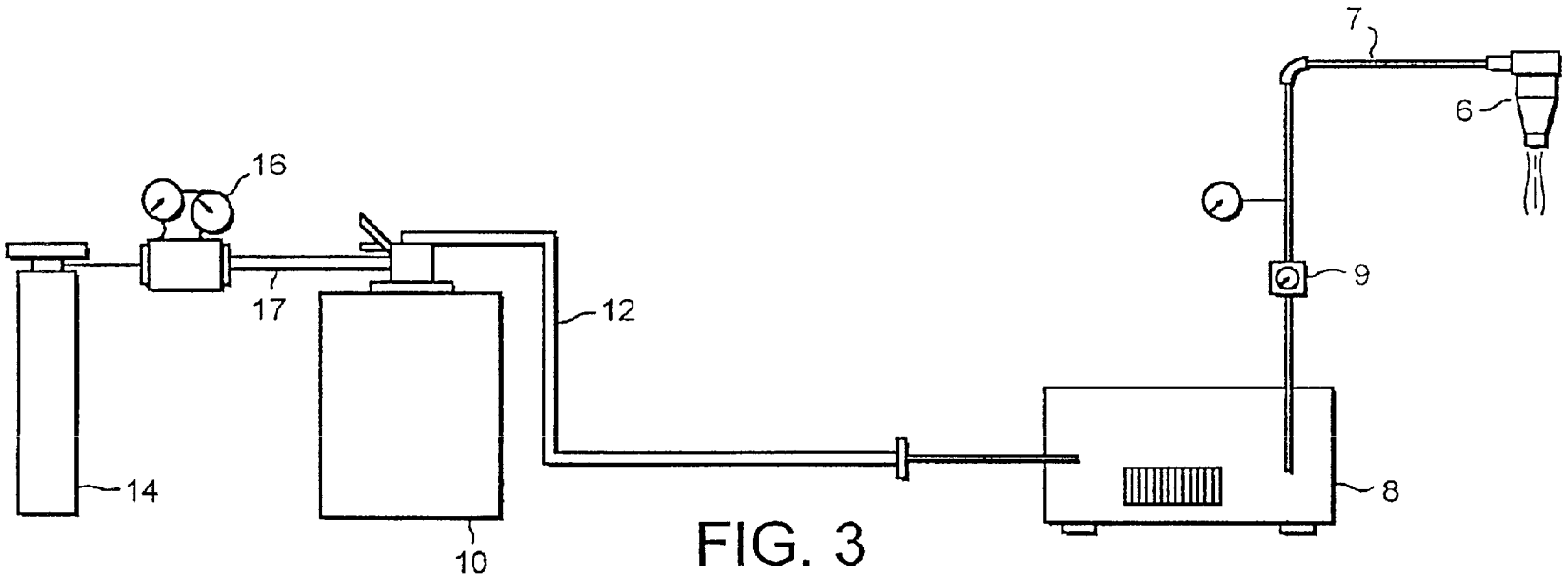
FIG. 3 is a diagrammatic view showing the connection between a keg of beer and a beer dispensing apparatus including a tap according to the invention.

FIG. 3 illustrates a beer dispensing system including a tap according to the first embodiment of the invention. The dispensing arrangement is otherwise standard. Tap 6 is connected via a pipe 7 to a remote cooler 8 of known form. A valve 9 is provided in the pipe 7 so as to control the supply of beer to the tap. Although the valve is shown here as being provided in the pipe remote from the tap, in the second embodiment of the invention, the valve is provided integrally with the tap, as will be described later in more detail. As will be described in greater detail with reference to FIG. 26 below, a capillary tube could be provided in the place of pipe 7.

The beer is supplied to the cooler from a keg 10 which is connected to the cooler by a pipe 12. The pressure of the beer in the system is controlled by a gas cylinder 14 and pressure gauge 16 which are connected to the keg via a further pipe 17.

As is conventional in so-called pressure raising systems, the draught beer is supplied under pressure which is maintained by a cylinder of $CO_2$ and it is this pressure which forces the beer through the dispensing systems.

Figure 4:
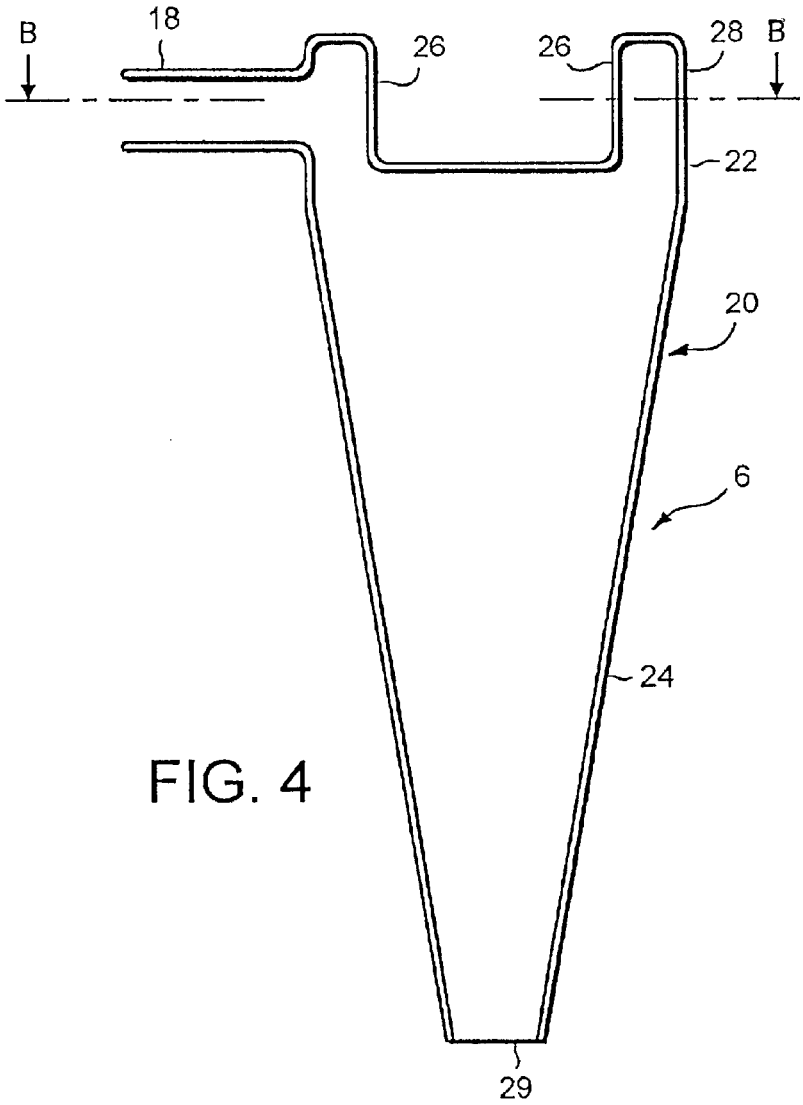
FIG. 4 is a longitudinal sectional view of a first embodiment of a tap according to the invention.
Figure 5:
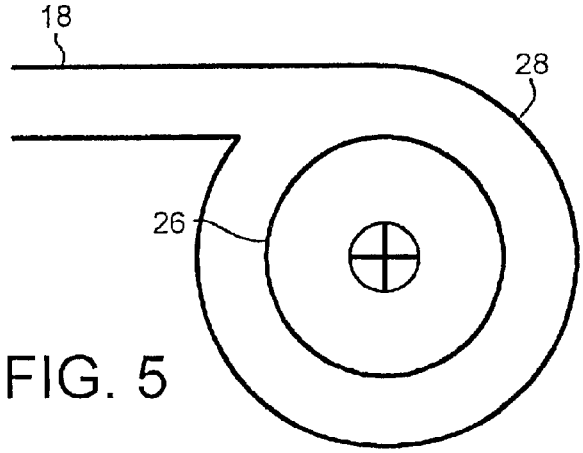
FIG. 5 is a section on B—B through the tap of FIG. 4.

The first embodiment of a beer dispensing tap 6 according to the invention is shown in more detail in FIGS. 4 and 5. The tap shown may be made of stainless steel, although it could alternatively be made of plastics or glass.

The tap 6 has an inlet 18 which extends horizontally (as illustrated) and tangentially to the main tap body 22.

The inlet is in use connected to a pipe 7 as shown in FIG. 3. Thus when valve 9 of FIG. 3 is opened, beer flows into the tap main body via the inlet 18.

The tap main body 20 is made up of an upstream portion which forms a vortex finding chamber 22 within it and a downstream portion 24 depending from the vortex finding chamber.

The vortex finding chamber 22 is annular in form having inner 26 and outer 28 walls. The inner wall 26 forms a so-called vortex finder. Thus, beer flowing into the vortex finding chamber will flow helically around the vortex finder between its inner and outer walls so as to set up a vortex flow in the body of the beer. The downstream portion 24 is frusto-conical in form, having a cross sectional diameter which decreases in the direction of through-flow of the beer. Therefore, on entering the downstream portion of the tap, the beer will continue to flow helically through the tap and will be accelerated towards the tap exit 29 due to the decreasing diameter of the downstream portion.

The tap described in this embodiment could be held in any orientation to dispense beer. It is believed however that the best results would be obtained when the tap was oriented vertically.

Figure 6:
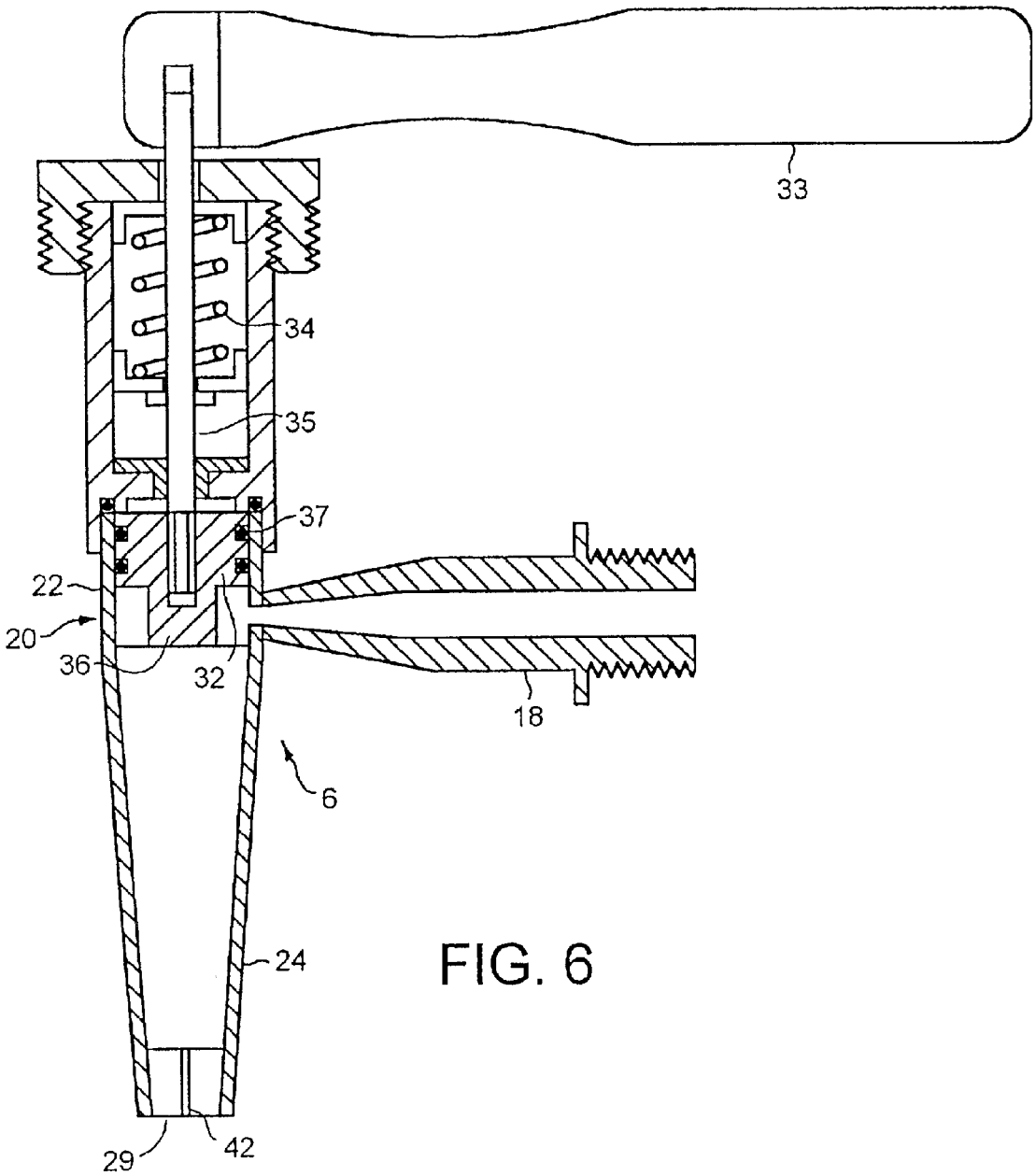
FIG. 6 is a longitudinal sectional view of a second embodiment of a tap according to the invention, having a sealing valve shown in the open position.

An alternative embodiment of a beer dispensing tap 6 according to the invention is shown in FIG. 6. The tap 6 itself has a main body 20 which has a straight hollow cylindrical upper portion 22 and a hollow tapering portion 24 extending below it. An inlet pipe 18 is provided in the straight upper portion which joins the upper portion at a tangent thereto. A valve 32 for opening and closing the tap is also provided in the upper portion thereof. The valve is operated by means of a mechanism including a handle 33 and drive shaft 35 which acts on a compression spring 34 located above the valve head which biases the valve closed. Sealing rings 37 are provided between the valve head and the inner surface of the upper portion 22 of the tap body 20.

Figure 7:
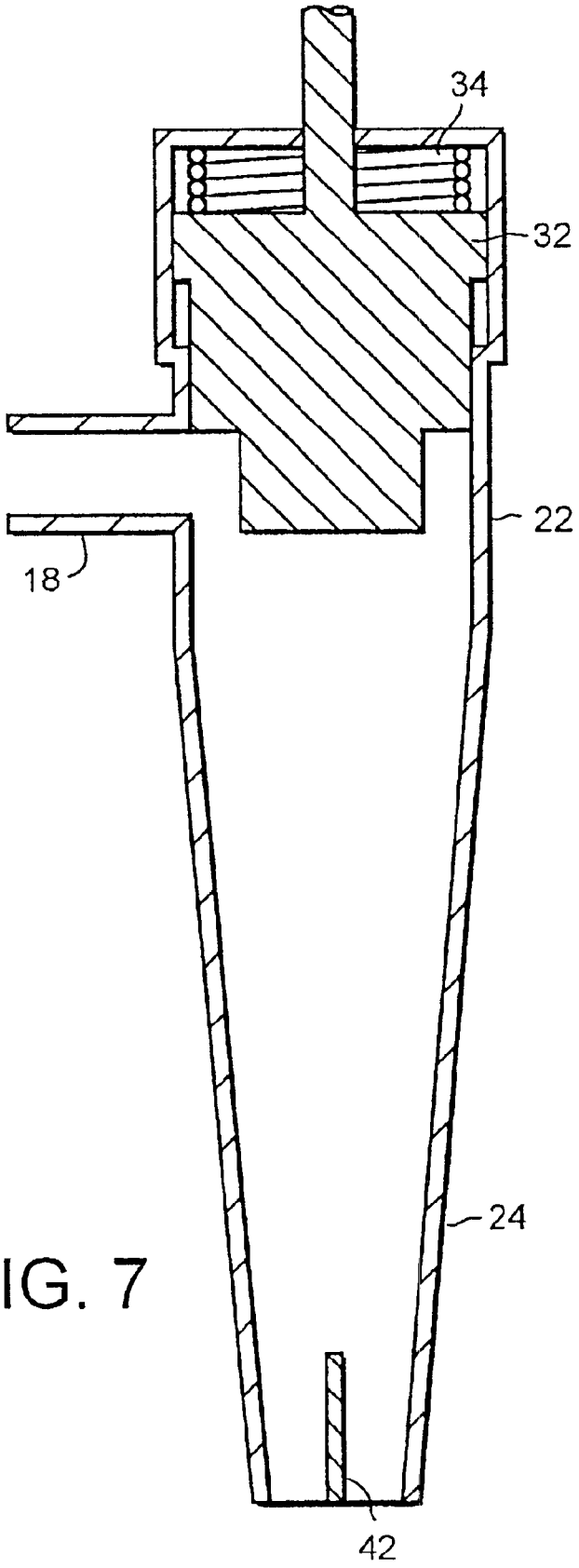
FIG. 7 is a longitudinal sectional view of the tap of FIG. 6, with the sealing valve shown in the open position.

A vortex finder 36 having a cylindrical form of a diameter significantly smaller than the upper tap body is attached to the valve. Therefore, when the valve is depressed, the vortex finder extends below the inlet pipe and the wider part of the valve blocks the inlet to the tap. However, as shown in FIG. 7, when the valve is raised to open the tap, the vortex finder is located at the height of the inlet pipe. Thus an annular flow chamber (or vortex finding chamber) is defined between the wall of the vortex finder and the inner surface of the upper portion of the tap body when the valve is open. Therefore, beer flowing into the tap will be directed helically around the inside of the tap with the help of the vortex finder.

As seen in FIGS. 6 and 7, a vortex breaker 42 is provided in the tapered portion 24 of the tap body 6 and comprises a blade 64 extending diametrically across the tapered portion 24.

Figure 8:
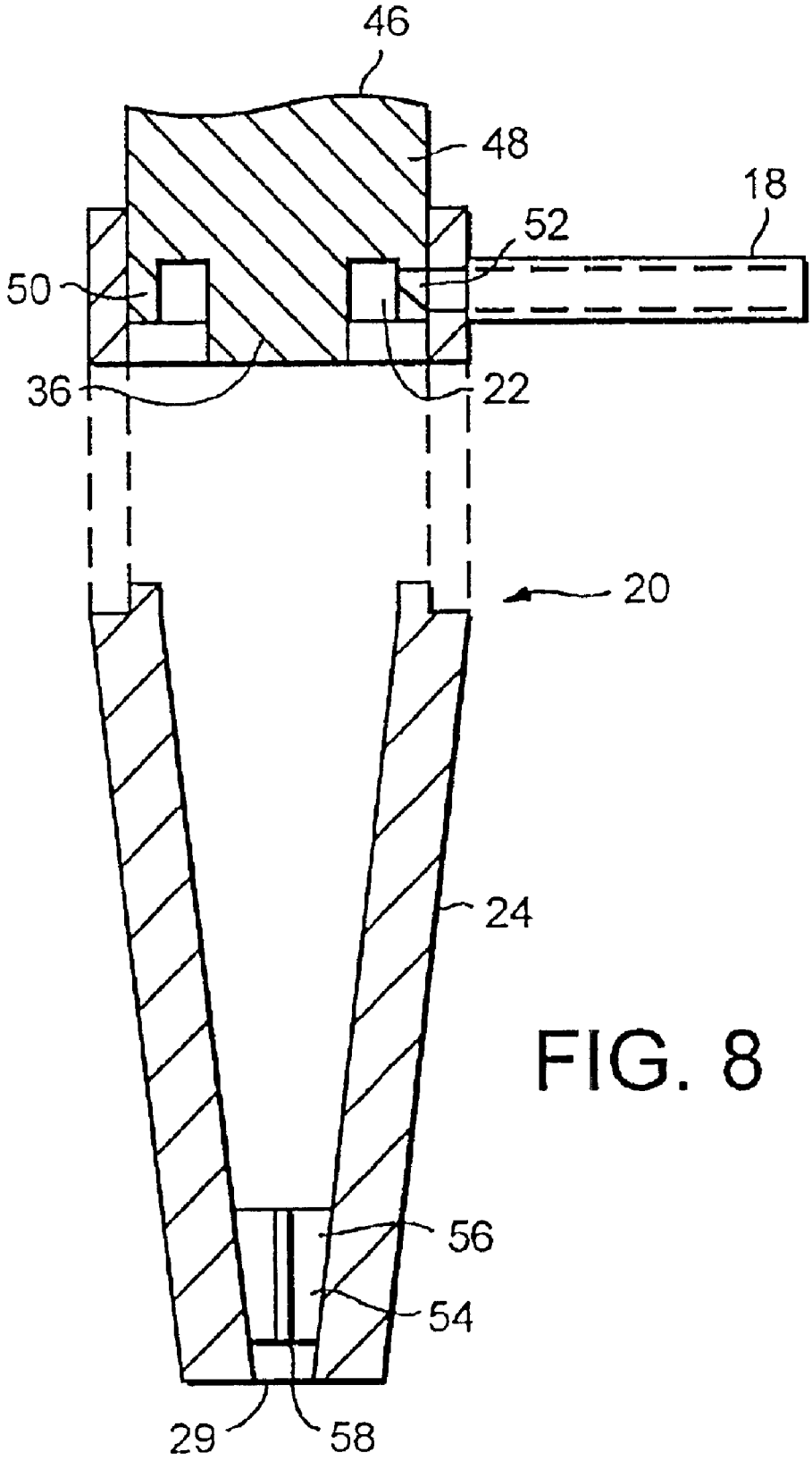
FIG. 8 is a longitudinal sectional and partially exploded view of a third embodiment of a tap according to the invention, having an alternative form of sealing valve shown in the open position.

FIG. 8 shows an alternative embodiment of a beer tap according to the invention. Parts of the tap corresponding to the embodiments described above have been given the same reference numerals.

As seen in FIG. 8, the basic structure of the tap is substantially the same as that of the previous embodiments. Thus, the tap main body 20 comprises a lower frustoconical portion 24 and an upper portion defining vortex finding chamber 22. A horizontal tangential flow inlet pipe 18 is provided to the vortex chamber 22.

A valve 44 which is different to that of the previous embodiments is provided for opening and closing the tap as described below. The valve 44 comprises a rotary valve member 46 located within the vortex chamber 22 and means (not shown) for rotating the rotary valve member between the "on" and "off" positions.

The rotary valve member 46 comprises an upper solid cylindrical portion 48, which fits sealingly within the vortex chamber 22 above the inlet pipe 18 and a circumferential wall portion 50 extending from the upper portion 48 to a level below the inlet pipe 18 and also fitting sealingly within the vortex chamber 22. An inlet port 52 is provided in the circumferential wall portion 50, level with the inlet pipe 18 such that the inlet port 52 and inlet pipe 18 may be aligned to allow beer to flow into the tap and the tap can be shut by rotating the valve member 46 so that the inlet port 52 is out of alignment with the inlet pipe 18.

An aperture (not shown) is also provided in the valve to allow venting of the tap to atmosphere when the valve is closed such that the tap is self draining. This is a desirable feature for hygiene reasons.

As also shown in FIG. 8, a vortex finder 36 depends from the upper cylindrical portion 48 and functions in the same manner as the vortex finder 36 of FIGS. 6 and 7.

The vortex breaker 54 is located within the lower part 24 of the tap body 20 and comprises two blades 56, 58 arranged as a cross.

Figure 2:
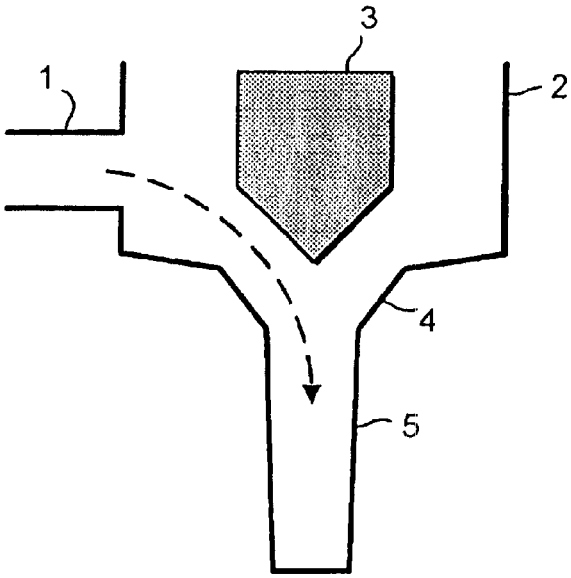
FIG. 2 Prior Art
FIG. 2 is a schematic sectional view along line A—A of FIG. 1.

Some tests of taps according to the invention have shown that the maximum pressure drop in the beer being dispensed through the whole tap is approximately 0.5 bar (50 kPa). In contrast, the pressure drop across a prior art tap having a flow pattern as shown in FIGS. 1 and 2 is approximately 1.5 bar (150 kPa). This pressure drop is made up of a pressure drop of up to 1 bar (100 kPa) across a standard flow restrictor disk and a further pressure drop of about 0.5 bar (50 kPa) across the tap due to loss of energy in the beer flowing through the tap.

Thus, as the pressure drop across the tap of the invention is only about one third of the pressure drop found in prior art dispensing systems, the beer in the keg can be provided at a lower pressure. This is beneficial as it means that beer provided in kegs for dispensing from taps according to the invention can be provided at a lower top pressure.

Details of tests carried out on a prior art tap and various taps embodying the invention are given below.

Tests were carried out on six different taps as identified in table 1.

TABLE 1

Figure 23:
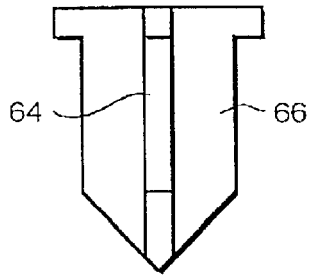
FIG. 23 is a longitudinal cross section through a vortex breaker.
Figure 24:
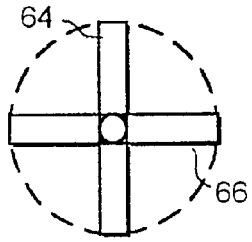
FIG. 24 is a top plan view of the vortex breaker of FIG. 23.
Figure 25:
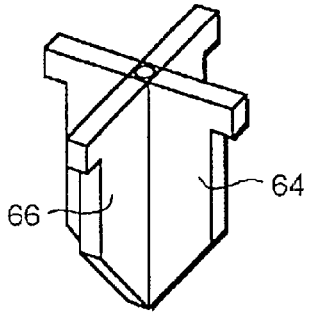
FIG. 25 is a perspective view of the vortex breaker of FIG. 23.

| Tap No. | Type | Shown in FIG. Nos. |
|---|---|---|
| 1 | Standard Alumasc tap | 1 and 2 |
| 2 | 8 mm outlet nozzle, vortex breaker has 2 perspex blades | 9 to 11 |
| 3 | 6 mm outlet nozzle, vortex breaker comprises a straight bore nozzle and 1 perspex blade | 12 to 14 |
| 4 | 8 mm outlet nozzle, vortex breaker has 2 stainless steel blades | 15 to 17 |
| 5 | 6 mm outlet nozzle, vortex breaker has 2 stainless steel blades | 18 to 20 |
| 6 | 6 mm outlet nozzle, a modified flow director as shown in FIGS. 23–25 was used | 21 and 22 |

Tap 1 as shown in FIGS. 1 and 2 has been described in the introduction above.

It will be appreciated that FIGS. 9 to 23 are schematic such that wall thicknesses of the taps are not shown. However, each of the taps shown in FIGS. 9 to 23 is made of perspex and has a wall thickness suitable for this material. The dimensions given for all of the elements shown in FIGS. 9 to 23 relate to the relevant internal dimensions of those elements.

Figure 9:
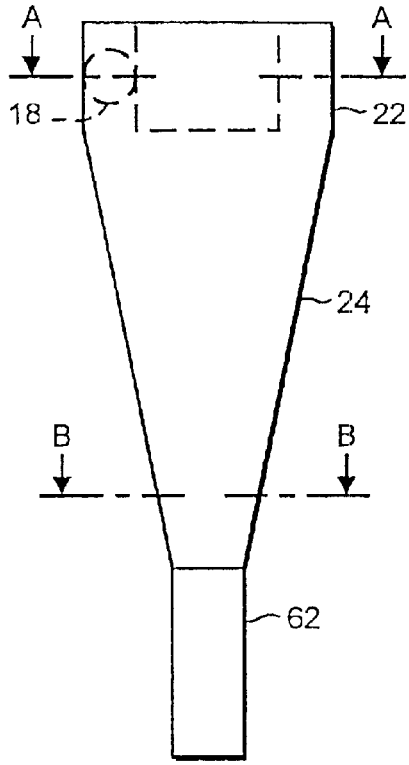
FIG. 9 is a longitudinal sectional view of a further embodiment of a tap according to the invention, referred to as tap number 2 in the following description.
Figure 10:
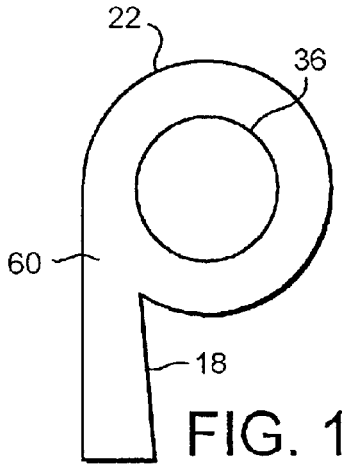
FIG. 10 is a section along line AA of FIG. 9.
Figure 11:
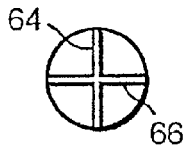
FIG. 11 is a section along line BB of FIG. 9.

As shown in FIGS. 9 to 11, tap number 2 comprises a lower frusto-conical portion 24, the outlet diameter of which is 8 mm. The lower portion 24 extends over a height of 50 mm and is tapered at an angle of 5°. The diameter of the outlet opening in the base of the lower frusto-conical portion 24 is 8 mm.

A vortex finding chamber 22 is provided above the lower portion 24 and this has the same dimensions in each of tap numbers 2 to 6.

The vortex chamber 22 has a height of 10 mm and diameter of 20 mm. A vortex finder 36 located centrally within the vortex chamber extends over the whole height of chamber 22 and has a diameter of 10 mm. An inlet opening 60 is provided in the wall of the vortex chamber 22. The opening 60 is circular, has a diameter of 5 mm, and is located at mid-height in the vortex chamber 22.

In each of the tap numbers 2 to 5, an inlet pipe 18 having a free-hand blended taper of its inner bore is attached to the inlet opening 60. The pipe has an internal diameter of 5 mm at the end corresponding to the inlet opening 60 and a greater diameter of about 6.5 mm at its widest point. The inlet pipe 18 of tap number 6 has a smooth machined taper of its inner bore and thus the transition from a diameter of 5 mm to 6.5 mm in this pipe is exact and the gradient of the bore is constant. The taper of the inlet pipe 18 (in either the hand-blended or machined case) has the effect of accelerating beer as it flows towards the vortex chamber and this is thought to be advantageous in the functioning of the tap as will be described further below.

As shown in FIGS. 9 and 11, the vortex breaker of tap number 2 comprises two perspex blades 64, 66 having a thickness of 1 mm and height of 13 mm and forming a cross within the bottom part of lower portion 24. In addition, a tubular element 62 is attached to the outlet of the lower portion 24. This element has a constant diameter of 8 mm and a length of 30 mm. Thus, the diameter of the tubular element corresponds to that of the outlet opening.

Figure 12:
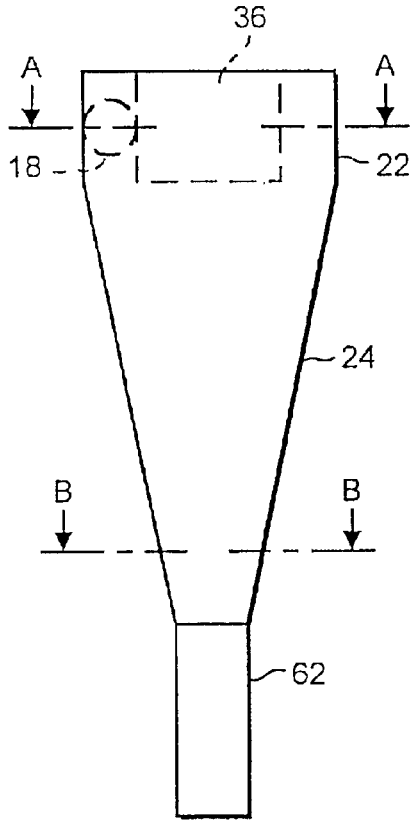
FIG. 12 is a longitudinal sectional view of a further embodiment of a tap according to the invention, referred to as tap number 3 in the following description.
Figure 13:
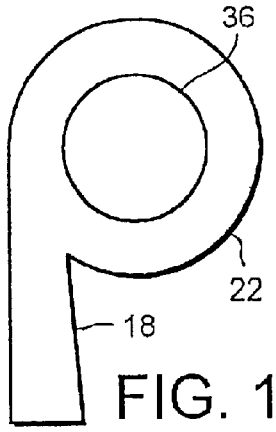
FIG. 13 is a section along line AA of FIG. 12.
Figure 14:
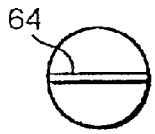
FIG. 14 is a section along line BB of FIG. 12.

Tap number 3 is shown in FIGS. 12 to 14. This tap has a largely similar structure to that of tap number 2 and, in particular, the vortex chamber 22 and inlet pipe 18 are identical to those of tap number 2. The dimensions of the lower frusto-conical portion 24 of the tap body are however different to those of tap number 2. The lower portion 24 again has a height of 50 mm. However, the taper angle of the lower portion is 7° such that the diameter of the outlet opening at the base of the frusto-conical portion is 6 mm rather than 8 mm. Further, the vortex breaker comprises only a single perspex blade having the same dimensions as the blades of tap number 2. A straight tubular member 62, having a length of 30 mm is provided at the tap outlet as in tap No. 2. The diameter of the tubular member is 6 mm to correspond to the outlet diameter of the lower tap portion 24.

Figure 15:
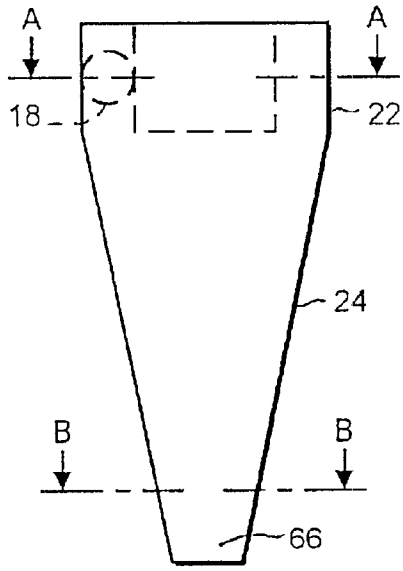
FIG. 15 is a longitudinal sectional view of a further embodiment of a tap according to the invention, referred to as tap number 4 in the following description.
Figure 16:
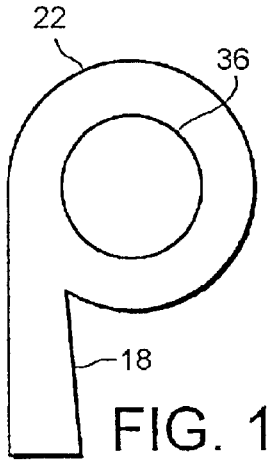
FIG. 16 is a section along line AA of FIG. 15.
Figure 17:
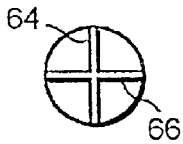
FIG. 17 is a section along line BB of FIG. 15.

Tap number 4 as shown in FIGS. 15 to 17 is identical to tap number 2 except that no tubular nozzle is provided at the tap outlet. In addition, the two blades 64, 66 of the vortex breaker are made of stainless steel rather than perspex. However, the dimensions of the blades again correspond to those of tap number 2.

Figure 18:
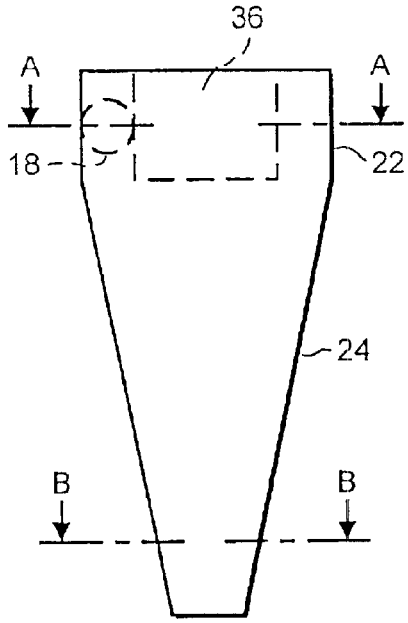
FIG. 18 is a longitudinal sectional view of a further embodiment of a tap according to the invention, referred to as tap number 5 in the following description.
Figure 19:
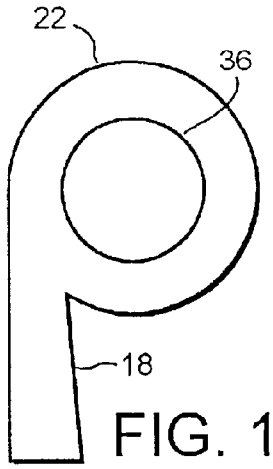
FIG. 19 is a section along line AA of FIG. 18.
Figure 20:
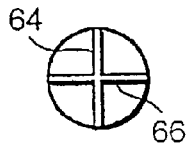
FIG. 20 is a section along line BB of FIG. 18.

Tap number 5 as shown in FIGS. 18 to 20 is identical to tap number 3 except that again, no tubular member is provided at the tap outlet. Further, the vortex breaker comprises two stainless steel blades having a thickness of 1 mm and height of 13 mm and forming a cross within the bottom part of the lower portion 24.

Figure 21:
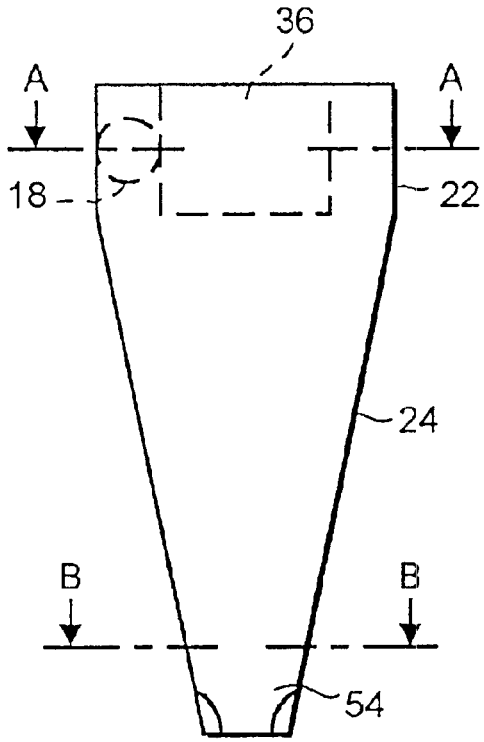
FIG. 21 is a longitudinal sectional view of a further embodiment of a tap according to the invention, referred to as tap number 6 in the following description.
Figure 22:
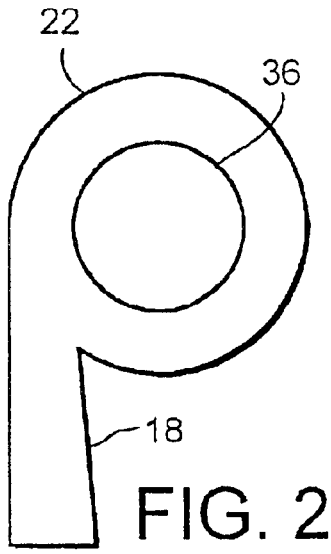
FIG. 22 is a section along line AA of FIG. 21.

Tap number 6 of FIGS. 21 and 22 corresponds substantially in structure and dimensions to tap numbers 3 and 5. As for tap number 5, no tubular member is provided at the top outlet. In addition, as discussed above, tap number 6 is the only tap in which the taper in inlet pipe 18 is machined so as to be smooth and exact.

The vortex breaker of tap number 6 is also slightly different to that of the other taps as a flow director of a standard type used in the industry is provided. As shown in FIGS. 23 to 25, the modified flow director comprises two blades 64, 66 forming a cross. The blades taper to a point at their lower ends unlike the blades of the other vortex breakers described. In addition, the vortex breaker is not attached within the lower conical portion 24 of the tap but instead merely sits in grooves provided in the inner surface of the lower conical portion. The dimensions of this vortex breaker are as shown in FIGS. 23 to 25 and it is made of black acetal.

The tests for each of the above described taps were carried out using Carlsberg lager at the following dispense conditions:

Keg temperature=approx. 20° C.

Top pressure on keg=1.7 bar (170 kPa)

Dispense time=14 seconds

Dispense temperature=5–7° C.

$CO_2$ content of keg=2.1 vols

Figure 26:
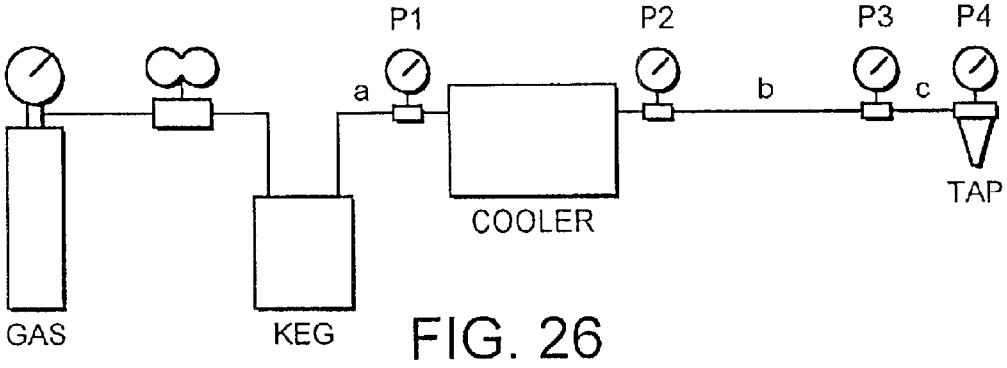
FIG. 26 is a schematic representation of the layout of a dispense line used in testing.

FIG. 26 shows the layout of the dispense system used which was essentially the same as that shown in FIG. 3.

Pressure gauges $P_1$ to $P_4$ were provided in the system so that the pressure of the beer before ($P_1$) and after ($P_2$) cooling, between the dispense and capillary tubes ($P_3$) and at the tap ($P_4$) could be measured. Some of the dimensions of the system were:

Tube a=keg tube −1 m length

Tube b=dispense tube −1 m length, 6.7 mm diameter

Tube c=capillary tube −0.63 m length, 3 mm diameter

Figure 27:
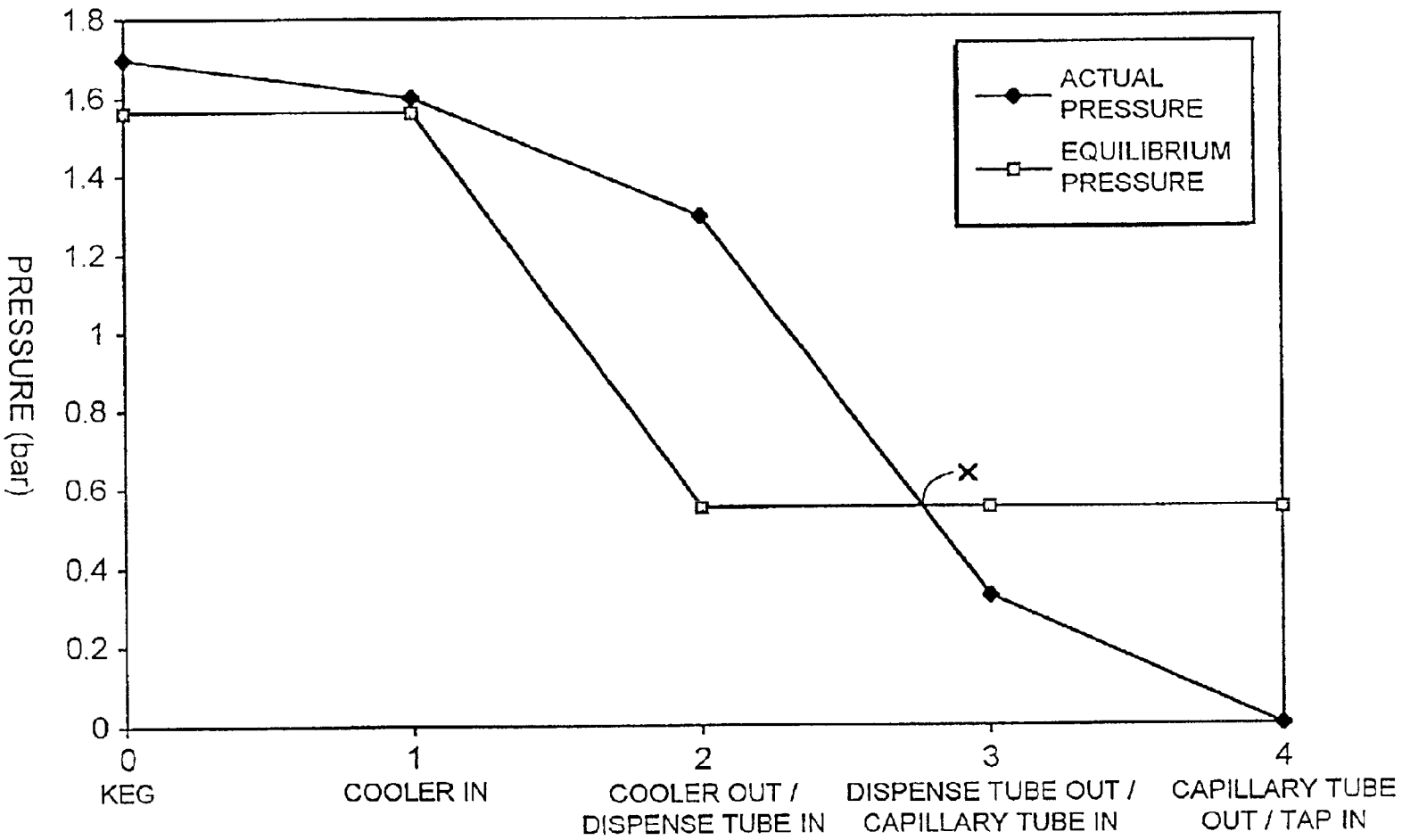
FIG. 27 is a graph showing the pressure drop during beer dispense using a system according to the invention.

FIG. 27 shows the drop in pressure in the beer as measured at $P_1$ to $P_4$ through the beer dispense line. The equilibrium pressure required to keep $CO_2$ in solution within the beer is also shown. As shown, the beer is initially under a top pressure of about 1.7 Bar (170 kPa). This is above the equilibrium pressure for the beer in the keg which is at a temperature of about 20° C. and so the $CO_2$ in the beer will be retained in solution. Any top pressure of $CO_2$ on the beer above the equilibrium pressure will cause more $CO_2$ to be dissolved into the beer and so the top pressure should not be too high relative to the equilibrium pressure.

As the beer is cooled between steps 1 and 2 of FIG. 27, the equilibrium pressure drops relatively steeply to a pressure of only about 0.544 Bar (54.4 kPa) at a temperature of between about 5 to 7° C. The actual pressure of the beer for dispense only drops by a relatively small amount through the cooler and so the $CO_2$ is still held in solution in the beer when it exits the cooler.

In order to provide the beer to the tap in a supersaturated state, the pressure of the beer is then dropped to below equilibrium pressure by flowing the beer through a capillary system (between points 2 and 4 of FIG. 27).

The pressure could alternatively be dropped below equilibrium pressure using a restrictor valve. However, ideally, the pressure drop is carefully controlled to get the beer to a critical level of supersaturation on reaching the tap or dispense point and a capillary system provides a very accurate means for controlling this pressure drop.

Once the pressure of the beer drops below the equilibrium pressure, the beer will be supersaturated. This corresponds to point X and beyond on FIG. 27. It is important to provide smooth flow surfaces for the supersaturated beer as any roughness on a flow surface could act as a nucleation site for gas breakout in the beer. Thus, by flowing the beer through capillaries at a constant rate to the tap, the beer is delivered in a supersaturated state with essentially no gas breakout as required.

During the tests, taps 1 to 6 were used to pour (Imperial) pints of Carlsberg lager under the dispense conditions described above. The time taken to pour each pint was 14 seconds. The Carlsberg lager used for the tests has a specification of 2.1 vols/vol of $CO_2$ measured at 0° C. and a pressure of one atmosphere (101.325 kPa). A reduction in the level of $CO_2$ in the beer results in a "flatter" or less sharp taste which is generally considered to be undesirable. Thus, a drop in volume of $CO_2$ of greater than about 0.5 vols/vol $CO_2$ should be avoided and the amount of $CO_2$ loss should be minimised to optimise the taste of the beer dispensed.

Figure 28:
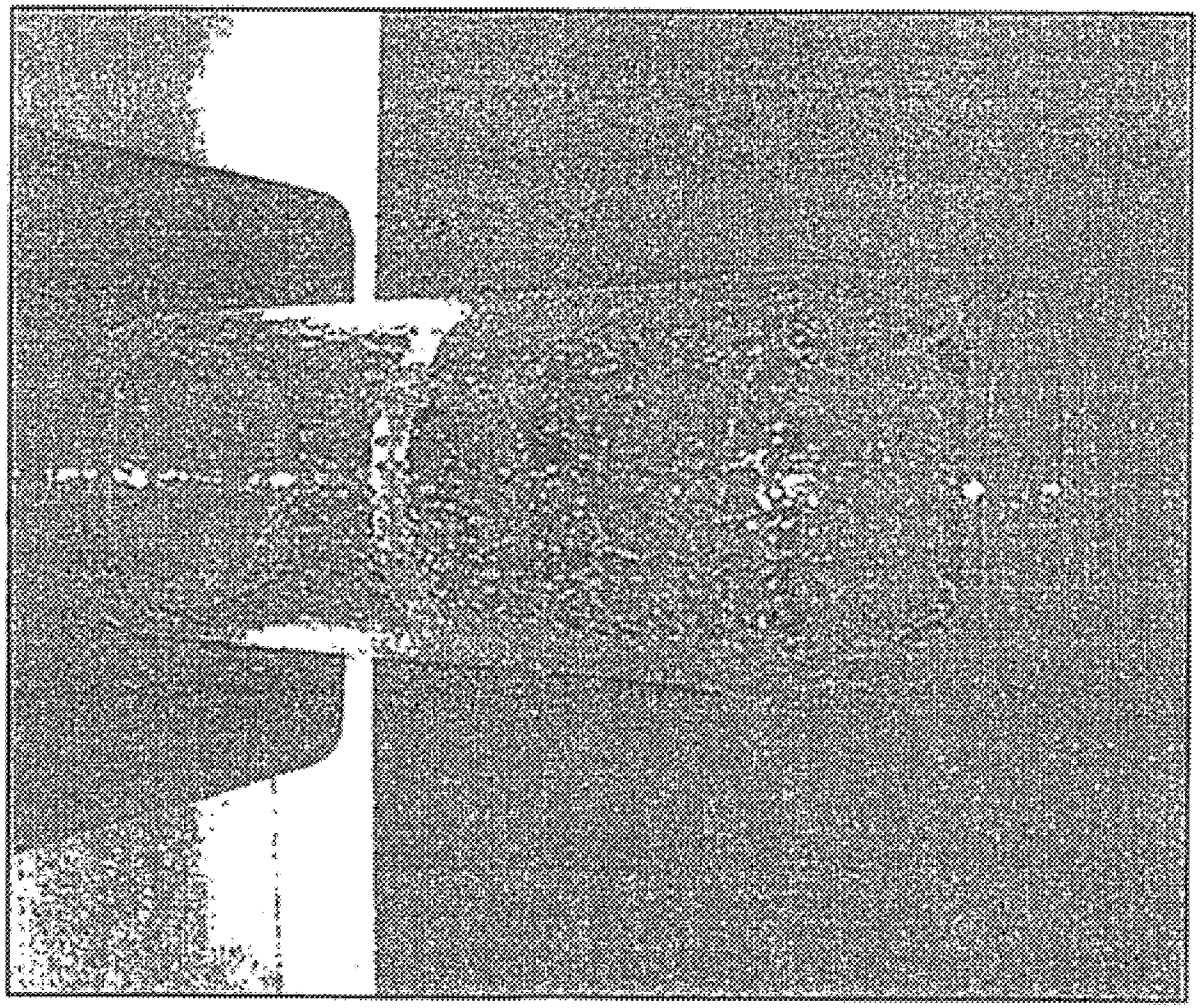
FIG. 28 is a photo of a beer glass which has been emptied showing a "lacing" effect as discussed below.

Another effect which is perceived as desirable in the brewing industry is that of "lacing". This is the phenomenon of waves of bubbles being left on the glass after it has been emptied of beer. A sample of this "lacing" as achieved from tap no. 6 is shown in FIG. 28.

Table 2 below shows the data obtained for each tap which was:

1) the average amount of $CO_2$ in the beer in Vols/vol, where this average was calculated from 6 measurements, taken as 3 measurements from 2 separate pints;
2) the measured depth of head on a pint of beer poured from the tap;
3) a description of the head;
4) an approximate retention time of the head; and
5) a description of the lacing obtained after pouring away the pints obtained from each tap.

TABLE 2

| Tap No. | $CO_2$ in glass | Average $CO_2$ | Depth of head | Description | Retention Time | Lacing | Additional Note |
|---|---|---|---|---|---|---|---|
| 1 | Measured from 1st pint 1.97/2.10/1.91 Measured from 2nd pint 1.93/2.06/2.08 | 2.008 | 2 mm | Very poor almost non-existent | Completely clear after 30 seconds | Very poor | Hard to produce any significant gas breakout to form head at this dispense temperature (5–7° C.) |
| 2 | Measured from 1st pint 1.93/1.88/2.02 Measured from 2nd pint 1.95/1.90/1.96 | 1.94 | 8 mm | Mostly tight/ creamy with some areas of larger bubbles | 3 minutes | Very good | Significantly better performance than standard (Tap 1) |
| 3 | Measured from 1st pint 1.93/1.91/1.91 Measured from 2nd pint 1.87/1.98/2.08 | 1.947 | 15 mm | Very tight/ creamy with small area of larger bubbles | 3.5 minutes | Extremely good - all the way down the glass | Noticeable improvement to the 8 mm tap (Tap 2) |
| 4 | Measured from 1st pint 1.97/1.90/1.98 Measured from 2nd pint 1.89/1.95/1.86 | 1.925 | 7 mm | Reasonably tight with some areas of larger bubbles | 2 minutes | Very good | Comparable performance to Tap No. 2 |
| 5 | Measured from 1st pint 1.85/1.86/1.95 Measured from 2nd pint 1.79/1.90/1.90 | 1.875 | 13 mm | Very tight/ creamy | 4 minutes | Very good - all the way down the glass | Comparable performance to Tap No. 3 |
| 6 | Measured from 1st pint 1.91/1.94/1.90 Measured from 2nd pint 1.88/1.97/2.00 | 1.933 | 16 mm | Extremely tight creamy | 4.5 minutes | Very good | Best performer in all areas |

The following conclusions can be drawn from the test results of Table 2. All tested embodiments of the invention dispense Carlsberg lager with significantly improved characteristics to those exhibited with standard taps. The improvements noted were:

i. Deeper head

11. Tighter/creamier head iii. More retentive head iv. Improved lacing appearance Further, Carlsberg lager can be dispensed from all embodiments containing comparable $CO_2$ contents. The 6 mm taps perform noticeably better than their 8 mm counterparts. The provision of a tapered inlet to the tap is thought to have a beneficial effect in producing a wider, more robust vortex in the beer flowing through the tap and thus promoting the formation of an improved head on the beer.

Double bladed vortex breakers break the vortex and straighten flow to a greater extent than the single bladed. Providing a secondary, straight bore, nozzle will however satisfactorily straighten flow out of single bladed taps.

The structure of the vortex in the free vortex tap has a profound effect upon the presentation of lager upon dispense. It was found that taps in which the vortex rotation was relatively fast, performed better than those in which a slower spin was observed.

The 6 mm taps tend to produce a faster spinning vortex, which has a stable rotation about one fixed vertical axis. This is due to an increased nozzle taper (7° as opposed to 5° in the 8 mm taps) which imparts a greater axial velocity upon the fluid. The 8 mm taps, however, exhibit vortices that have a slower spin and are thus less stable (tending to wobble).

This phenomenon is seen to effect the degree of gas breakout and ultimately the lager presentation, upon dispense. As the rotational velocity is inversely proportional to the pressure in the vortex, a faster spinning vortex will have a greater radial pressure drop. That is to say that there is a greater pressure differential between the periphery of the free vortex to its center. This physically means that any gas still in solution in the area of the vortex will be subjected to a greater level of supersaturation which provides the "driving force" to facilitate its breakout from solution in the central vortex core.

Experiments have shown that the dimensions of the tap inlet tube also profoundly effect the vortex proportions. Tap no. 6 was the best performing tap within the lager trials. The internal dimensions of this tap were identical to those of nos. 3 and 5 with the exception of the inlet tube. Tap no. 6 had a smooth, machined tapered inlet path (25 mm long, tapering from 6.5 mm to 5 mm) which imparts a degree of acceleration upon the fluid within. Acceleration in this region not only generates a faster rotational spin, but also increases the width of the vortex. These two factors combine to produce the superior performance exhibited in tap no. 6.

Figure 31:
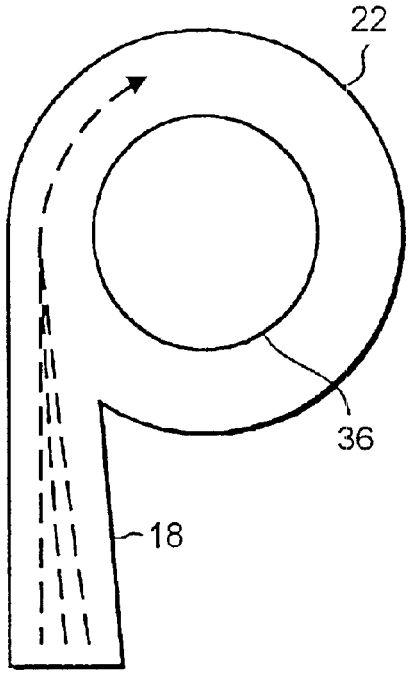
FIGS. 31 and 32 are sectional views through the top portion of a tap according to the invention.

The acceleration produced by the tapered inlet focuses the incoming fluid onto the back wall of the vortex finder head imparting a greater initial rotation of the fluid. (See FIG. 31)

Figure 32:
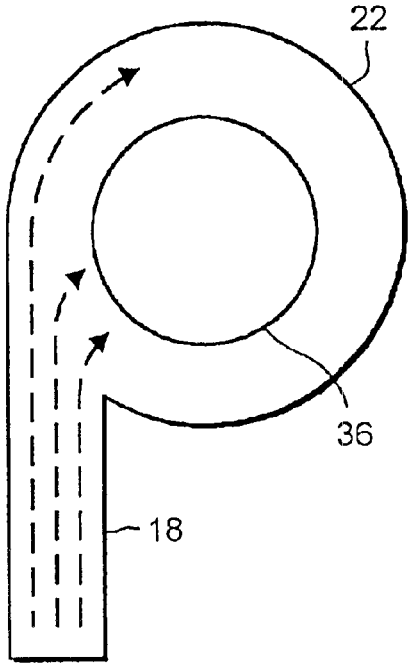

If the incoming fluid velocity is slower as it will be with a parallel bore inlet pipe, there exists scope for a short-circuiting of the rotational system. Some slow moving fluid may become stagnant against the vortex finder or may not in fact rotate around it at all. (See FIG. 32).

Figure 29:
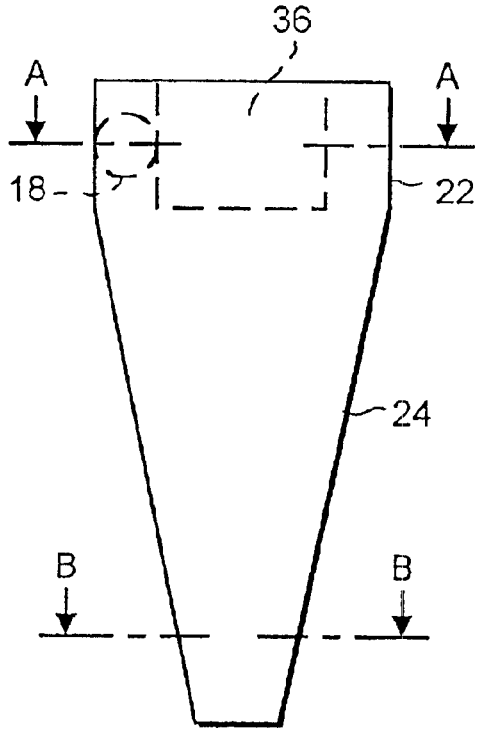
FIG. 29 is a longitudinal sectional view of an optimal embodiment of a tap according to the invention.
Figure 30:
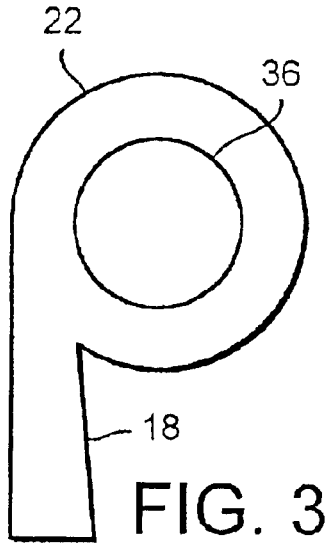
FIG. 30 is a section along line AA of FIG. 29.

Thus, the optimum design of a vortex tap for dispensing Carlsberg lager is as shown in FIGS. 29 and 30. This tap corresponds to tap No. 6 except that a vortex breaker comprising two perspex blades as in FIG. 11 is provided.

The optimum tap dimensions for dispense of Carlsberg lager are thus:

taper angle=7°

D=20 mm

Di=3.5 mm

Du=6 mm d=10 mm l=10 mm

L=50 mm where

D=diameter of vortex chamber

Di=inlet port diameter

Du=diameter of tap outlet

D=diameter of vortex finder l=height of vortex finder

L=height of lower conical tap portion

Thus, the optimum ratios of the various tap dimensions are:

di/D=0.15–0.25

Du/D=0.3 l/D=0.5 d/D=0.5

L/D=2.5

Further to the above, a range of ratios of the various tap dimensions for which vortexial beer dispense taps would function with lager to provide a good head without too high a level of gas breakout is given below:

D1/D=0.10–0.36

Du/D=0.10–0.36 l/D=0.3–0.6 d/D=0.3–0.6

L/D=0.75–5

The maximum possible height (L) of the lower conical portion 24 is about 100 mm and the minimum is about 30 mm.

It should however be noted that this lower value is limited by the flow rate achievable through the tap and the consequent time taken to pour a pint rather than the quality of head of beer produced.

Low carbonated ales and nitrogenated beer can also be dispensed successfully with taps according to the invention. However, the tap dimensions may have to be slightly altered compared to those found to be ideal for lager. These may be determined by means of experiments as set forth above to achieve optimum dispense conditions.

Further tests on the taps were also carried out to compare the use of a valve for opening and closing the tap provided in the inlet pipe 18 with one provided in the tap body itself. Two different taps were tested and these are shown in FIGS. 33 to 36.

Figure 33:
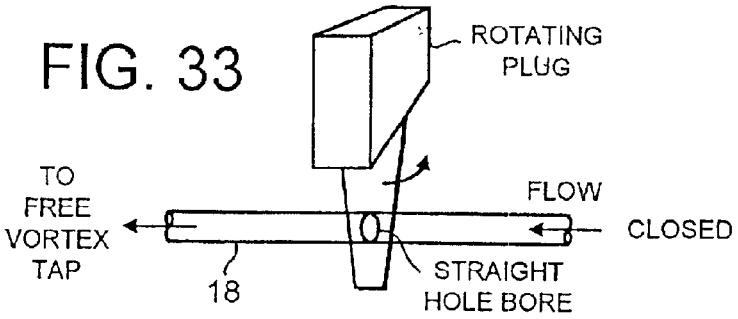
FIGS. 33 and 34 show a rotary valve in an inlet pipe in the closed and open positions respectively.
Figure 34:
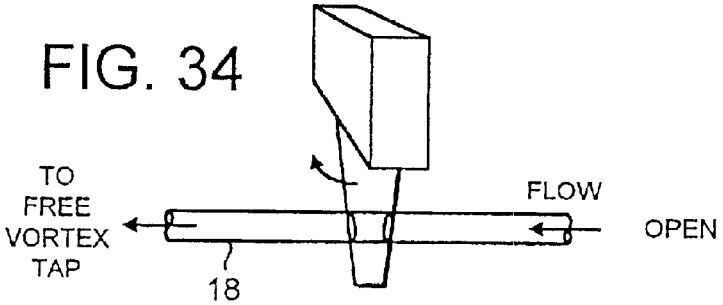

FIG. 33 shows a standard rotary valve in the closed position and FIG. 34 shows the same valve in the open position. Satisfactory pour results were achieved with this valve.

Figure 35:
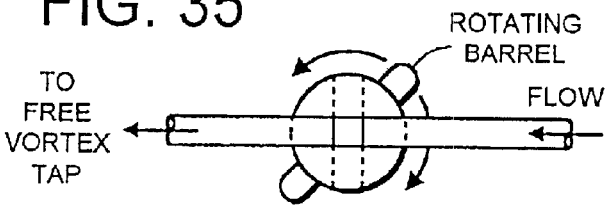
FIGS. 35 and 36 show a rotating barrel valve in an inlet pipe in the closed and open positions respectively.
Figure 36:
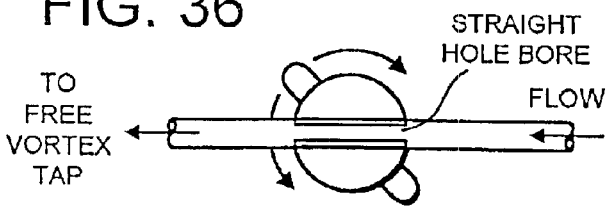

FIGS. 35 and 36 show an alternative rotary valve in both the closed and open positions. As shown this valve comprises a rotating barrel and satisfactory pour results were obtained with this valve also.

Thus, the tap of the present invention would function with a wide range of valves including all those types described in the application and also encompassing most known forms of valves for shutting off flow in an inlet pipe.

Figure 37:
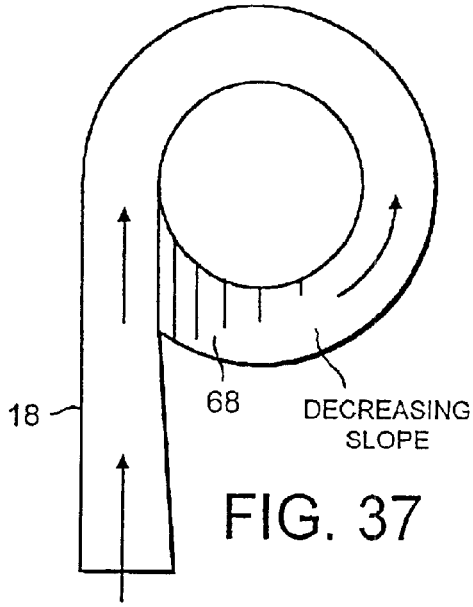
FIG. 37 is a schematic top plan view of a tap according to the invention and incorporating a further improvement thereto.
Figure 38:
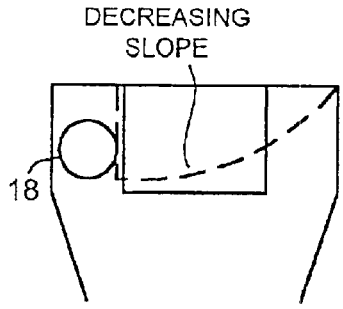
FIG. 38 is a schematic longitudinal sectional view of the tap of FIG. 37.

A further improvement to taps according to the invention may be made by providing means to ensure that the flow of beer or other beverage in the tap is forced around the vortex finder thus minimising any short-circuiting or stagnation in the flow. As shown in FIGS. 37 and 38, a stepped fitting 68 may be provided in the flow chamber, at the level of inlet conduit 18. In this way, liquid is forced to flow around the vortex finder 36 and will also be at a lower point in the flow chamber 22 on returning to a circumferential point corresponding to the point at which beverage enters the flow chamber. Thus, short-circuiting in the flow of beverage within the flow chamber is avoided as the beverage cannot catch up with itself at any stage while flowing around the flow chamber 22.

Figure 39:
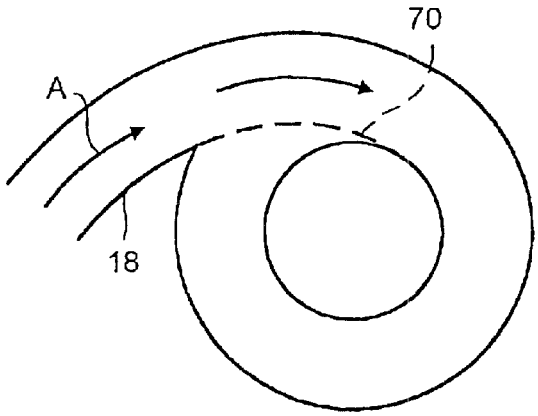
FIG. 39 is a schematic top plan view of a tap according to the invention and incorporating a further improvement thereto.

Alternatively or additionally, a barrier 70 is provided in the flow chamber 22 such that beverage entering the flow chamber 22 through inlet conduit 18 is forced to flow in the direction shown by arrow A in FIG. 39. The provision of such a barrier ensure that beverage entering the flow chamber 22 is forced to flow around the vortex finder 36.

What is claimed is:

1. Beer dispensing apparatus, the apparatus comprising a flow chamber having a substantially circular cross section, an inlet and an outlet, wherein the apparatus is configured such that in use a vortexial motion is formed in the mass of beer flowing through the apparatus such that gas separates out from the beer within the vortex formed an a head is formed on beer dispensed from the apparatus.

2. A beer dispensing apparatus as claimed in claim 1, wherein the inlet extends substantially at a tangent to the circular cross section of the flow chamber.

3. A beer dispensing apparatus as claimed in claim 2, wherein the inlet is a conduit which extends substantially perpendicular to the longitudinal axis of the flow chamber.

4. A beer beverage dispensing apparatus as claimed in claim 1, a vortex finder being provided within the flow chamber aligned in relation to the inlet such that in use, beer flowing into the flow chamber is guided in a circular path between the surface of the vortex finder and the inner face of the flow chamber.

5. A beer dispensing apparatus as claimed in claim 4, wherein the vortex finder comprises a portion in the form of a cylinder.

6. A beer dispensing apparatus as claimed in claim 5, wherein the vortex finder further comprises a conic or frusto-conic part provided at the downstream end thereof.

7. A beer dispensing apparatus as claimed in claim 5, wherein the vortex finder is provided integrally with a valve head.

8. A beer dispensing apparatus as claimed in claim 1, the apparatus being arranged to be oriented substantially vertically in use such that the beer flows helically downwardly through the apparatus under the action of gravity.

9. A beer dispensing apparatus as claimed in claim 1, wherein the circular cross section of at least a part of the flow chamber decreases in diameter along its axis in the downstream flow direction.

10. A beer dispensing apparatus as claimed in claim 1, wherein a vortex breaker is provided in the apparatus to smooth the flow of beer leaving the apparatus.

11. A beer dispensing apparatus as claimed in claim 1, the flow chamber comprising a hollow cylindrical upstream portion defining a vortex finding chamber and a conical or frusto-conical downstream portion depending therefrom.

12. A beer dispensing apparatus as claimed in claim 1, further comprising means for opening and closing the flow of beer into the apparatus.

13. A beer dispensing apparatus as claimed in claim 7, further comprising an outlet conduit leading from the flow chamber, wherein the inlet is arranged in relation to the flow chamber such that beer flowing into the apparatus in use is directed to flow around the valve head substantially in one direction.

14. A beer dispensing apparatus as claimed in claim 13, wherein the outlet conduit depends from the flow chamber and is arranged such that the flow of beer around the valve head establishes a vortex flow within the outlet conduit.

15. beer dispensing apparatus as claimed in claim 13, wherein a vortex breaker is provided in the outlet conduit to smooth the flow of beer leaving the apparatus.

16. A beer dispensing apparatus as claimed in claim 13, wherein the valve head is axially movable within the flow chamber in such a way that the valve head opens and closes the inlet conduit.

17. A beer dispensing apparatus as claimed in claim 16, wherein the valve head is provided with a vortex finding portion having a diameter significantly less than that of the flow chamber and a valve portion having a diameter substantially the same as that of the flow chamber, and the valve portion is operable to open and close the inlet conduit.

18. A beer dispensing apparatus as claimed in claim 1, the apparatus being made of stainless steel.

19. A beer dispensing apparatus as claimed in claim 1, the apparatus being made of glass.

20. A beer dispensing apparatus as claimed in claim 1, the apparatus being made of plastics.

21. A beer dispensing apparatus as claimed in claim 20, the apparatus being made of Perspex.

22. A beer dispensing apparatus as claimed in claim 6, wherein the conic or frusto-conic part thereof has a taper angle of up to 30°.

23. A beer dispensing apparatus as claimed in claim 22, wherein the conic or frusto-conic part thereof has a taper angle of less than 15° or preferably 10°.

24. A beer dispensing apparatus as claimed in claim 23, wherein the conic or frusto-conic part thereof has a taper angle of between 7° and 3°, preferably between 7° and 5°.

25. A beer dispensing apparatus as claimed in claim 24, wherein the conic or frusto-conic part thereof has a taper angle of about 5°.

26. A beer dispensing apparatus as claimed in claim 6, wherein the conic or frusto-conic part thereof has a height of between 100 mm and 30 mm.

27. A beer dispensing apparatus as claimed in claim 26, wherein the conic or frusto-conic part thereof has a height of about 50 mm.

28. A method of dispensing beer comprising forming a vortexial flow in the mass of beer as it is dispensed using the apparatus as claimed in claim 1.

29. A beer dispensing apparatus as claimed in claim 9, wherein the vortex breaker comprises a blade extending diametrically across a downstream portion of the flow chamber.

30. Beer dispensing apparatus, the apparatus comprising a flow chamber having a substantially circular cross section, an inlet and an outlet, wherein the inlet extends substantially at a tangent to the circular cross section of the flow chamber, and the apparatus is configured such that in use a vortexial motion is formed in the mass of beer flowing through the apparatus such that gas separates out from the beer within the vortex formed and a head is formed on beer dispensed from the apparatus.

31. Beer dispensing apparatus, the apparatus comprising a flow chamber having a substantially circular cross section, an inlet, an outlet and a vortex finder comprising a portion in the form of a cylinder, wherein the vortex finder is provided integrally with a valve head and is provided within the flow chamber aligned in relation to the inlet such that in use, beer flowing into the flow chamber is guided in a circular path between the surface of the vortex finder and the inner face of the flow chamber.

32. Beer dispensing apparatus, the apparatus comprising a flow chamber having a substantially circular cross section, an inlet and an outlet, wherein the circular cross section of the flow chamber decreases in diameter along its axis from the inlet to the outlet, and wherein the apparatus is configured such that in use a vortexial motion is formed in the mass of beer flowing through the apparatus such that gas separates out from the beer within the vortex formed and a head is formed on beer dispensed from the apparatus.

33. Beer dispensing apparatus, the apparatus comprising a flow chamber having a substantially circular cross section, an inlet, an outlet, and a vortex breaker comprising a blade extending diametrically across a downstream portion of the flow chamber, wherein the apparatus is configured such that in use a vortexial motion is formed in the mass of beer flowing through the apparatus such that gas separates out from the beer within the vortex formed and a head is formed on beer dispensed from the apparatus.

* * * * *